United States Patent [19]

Gamble

[11] Patent Number: 4,617,877

[45] Date of Patent: Oct. 21, 1986

[54] FLUIDIZED BED STEAM GENERATOR AND METHOD OF GENERATING STEAM WITH FLYASH RECYCLE

[75] Inventor: Robert L. Gamble, Wayne, N.J.

[73] Assignee: Foster Wheeler Energy Corporation, Livingston, N.J.

[21] Appl. No.: 754,782

[22] Filed: Jul. 15, 1985

[51] Int. Cl.[4] ..... F22B 1/00

[52] U.S. Cl. ..... 122/4 D; 110/216; 110/245; 110/263

[58] Field of Search ..... 110/245, 263, 204, 216; 122/4 D; 431/7, 170

[56] References Cited

U.S. PATENT DOCUMENTS

| | | | |
|---|---|---|---|
| 3,893,426 | 7/1975 | Bryers | 122/4 D |
| 4,184,455 | 1/1980 | Talmud et al. | 122/4 D |
| 4,250,839 | 2/1981 | Daman | 122/4 D |
| 4,454,838 | 6/1984 | Strohmeyer, Jr. | 122/4 D |
| 4,469,050 | 9/1984 | Korenberg | 122/4 D |

*Primary Examiner*—Albert J. Makay
*Assistant Examiner*—Steven E. Warner
*Attorney, Agent, or Firm*—Marvin A. Naigur; John E. Wilson; Warren B. Kice

[57] ABSTRACT

A steam generator in which a plurality of vertically spaced fluidized beds are provided in a single enclosure, with one boundary wall of the enclosure having openings therein for permitting the discharge of effluent gases from the fluidized beds. A heat recovery enclosure is defined adjacent the beds for receiving their effluent gases and a fluidized bed is disposed in the heat recovery enclosure. A separator system is disposed adjacent the heat recovery enclosure and receives the effluent gases from the heat recovery enclosure and separates the entrained solid particles therefrom. The separated particles are reinjected into the fluidized bed in the heat recovery enclosure.

19 Claims, 2 Drawing Figures

FLUIDIZED BED STEAM GENERATOR AND METHOD OF GENERATING STEAM WITH FLYASH RECYCLE

BACKGROUND OF THE INVENTION

This invention relates to a fluidized bed heat exchanger and a method of generating steam, and, more particularly to such a generator and method in which a plurality of stacked fluidized beds are provided for generating heat.

Fluidized beds are well recognized as attractive heat sources since they enjoy the advantages of an improved heat transfer rate, while permitting a reduction in corrosion, boiler fouling, and sulfur dioxide emission.

In a typical fluidized bed arrangement, air is passed upwardly through a mass of particulate material causing the material to expand and take on a suspended or fluidized state. However, there is an inherent limitation on the range of heat input to the water passing in a heat exchange relation to the fluidized bed, largely due to the fact that the quantity of air supplied to the bed must be sufficient to maintain same in a fluidized condition yet must not cause excessive quantities of the particulate material to be blown away.

This disadvantage is largely overcome by the heat exchanger disclosed in U.S. Pat. No. 3,823,693 issued to Bryers and Shenker on July 16, 1974, and assigned to the same assignee as the present application. In the arrangement disclosed in the latter patent, the furnace section of the heat exchanger is formed by a plurality of vertically stacked chambers, or cells, each containing a fluidized bed. The fluid to be heated is passed upwardly through the fluidized beds in a heat exchange relation thereto to gradually raise the temperature of the fluid. A tube bundle is located in the area above each bed to provide a convection surface for the effluent gases from each bed.

However, the volume of space available above each bed to receive the convection surface is relatively small due to limitations placed on the cross-sectional area of each cell caused by tube spacings, welding accessibility, combustion requirements, etc. As a result, the convection surface defined by the tube bundles is limited to an extent that the mass flow of the effluent gases per area of convection surface and the resulting heat transfer coefficient above each bed, is less than optimum.

Another problem associated with the above type arrangement is the fact that, due to space limitations, the particulate fuel material is injected into the fluidized bed from a point below the upper surface of the bed. This compromises mixing of the material in the bed which impairs the efficiency of overall operation.

In U.S. Pat. No. 4,250,839 issued to Ernest L. Daman on Feb. 17, 1981, and also assigned to the same assignee as the present application, a vapor generator is disclosed in which a heat recovery enclosure is disposed adjacent the furnace section formed by the stacked fluidized beds. In this arrangement the solid particulate materials entrained in the effluent gases are separated in the heat recovery enclosure and reinjected back into a separate isolated bed. Although this provides an adequate convection surface, the material handling equipment required to insure proper flow of the gases and the solid particulate material is very complex and expensive.

SUMMARY OF THE INVENTION

It is therefore an object of the present invention to provide a steam generator and a method for generating steam which enjoys the advantages of stacked fluidized beds, yet provides a convection heat transfer surface of optimum size.

It is a further object of the present invention to provide a steam generator and method of the above type in which the material handling complexities associated with the reinjection of the separated solid particulate material into a separate bed are minimized.

Toward the fulfillment of these and other objects, a plurality of vertically stacked fluidized beds are disposed in a furnace enclosure, and a heat recovery enclosure is defined adjacent the furnace enclosure for receiving the effluent gases from the fluidized beds. A fluidized bed is defined in the heat recovery enclosure and one or two separators are provided adjacent the heat recovery enclosure for receiving the effluent gases and separating the entrained solid particles therefrom. The separated solid particles are then injected into the fluidized bed in the heat recovery enclosure.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENTS

Figure 1:
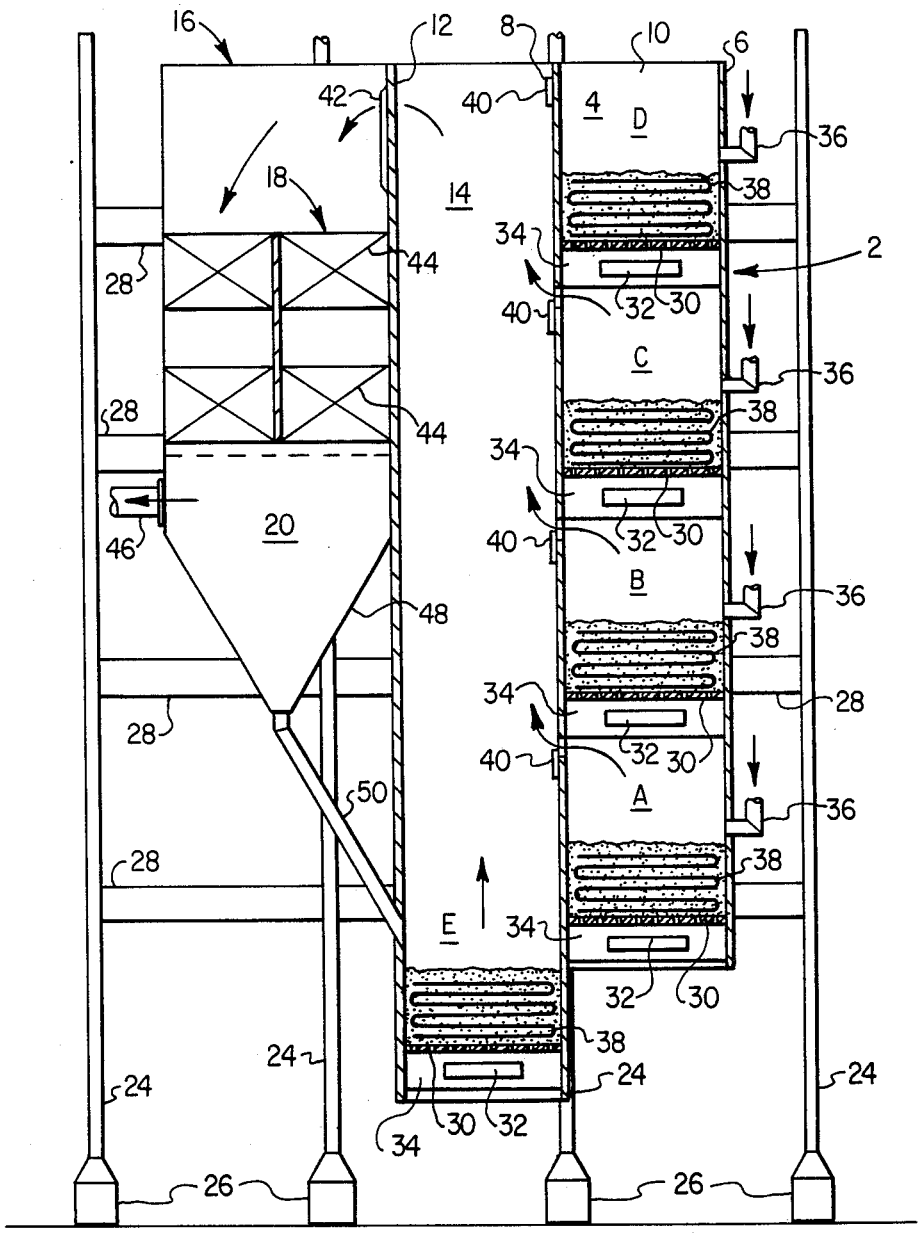
FIG. 1 is a schematic, vertical sectional, view of the steam generator of the present invention.

The steam generator of the present invention is shown in general by the reference numeral 2 in the drawing, and includes a furnace section formed with four primary fluidized bed cells A, B, C, and D extending in a chamber 4 defined by a front wall 6, a rear wall 8, a side wall 10, and another side wall not shown. The details of each bed cell A, B, C, and D will be described later.

An additional wall 12 is disposed in a spaced relation to the rear wall 8 to form a heat recovery chamber 14 adjacent the chamber 4. A housing 16 is disposed adjacent the wall 14 and contains a two-pass convection section 18 and a dust collector 20. The dust collector 20 is a multi-cyclone type device that functions like a cyclone separator but operates at a relatively cool (700° F.) temperature. The entire assembly thus described is supported by a plurality of spaced parallel vertical support beams 24 each extending from an enlarged base support 26 to a roof (not shown), and a plurality of spaced horizontal cross beams 28 connected to the beams 24. Since the specific manner in which the steam generator is connected to and supported by this support system is conventional, it will not be described in any further detail.

Four horizontal, perforated, air distribution plates 30 are disposed in a vertically spaced relation between the walls 6 and 8 and extend within the bed cells A, B, C, and D respectively. An air inlet 32 is associated with each bed cell A, B, C, and D and extends through the side wall 10 into an air plenum chamber 34 extending below each of the plates 30. As a result, air is distributed into each bed cell A, B, C, and D, with the flow being controlled by dampers, or the like (not shown).

Overbed fuel feeders 36 at four elevations are mounted on the front wall 6 and communicate with the bed cells A, B, C, and D, respectively. The overbed fuel feeders 36 are adapted to receive particulate fuel from an external source, such as a belt feeder, or the like (not shown), and discharge same into each bed cell. It is understood that a similar feed arrangement may be provided for an absorbent, such as limestone, for absorbing the sulfur generated as a result of the combustion of the particulate fuel, in a conventional manner. The particulate fuel and the absorbent thus form a bed of material in each bed cell A, B, C, and D which is fluidized by the air passing upwardly through the plates 30 and into each bed.

A tube bundle 38 is disposed immediately above the plates 30 and within the fluidized bed formed in each bed cell A, B, C, and D. Each tube bundle is connected to a system (not shown) for circulating water through the tubes to remove heat from the fluidized beds in a conventional manner. It is understood that appropriate headers, downcomers, and the like (not shown), are provided for circulating water or steam through each tube bundle 38 to transfer heat generated in the bed to the water or steam. A plurality of openings 40 are formed through the wall 8 to enable the effluent gases generated in each bed cell A, B, C, and D to be discharged from the chamber 4 into the chamber 14. A fluidized bed cell E is disposed in the lower portion of the chamber 14 and since it is identical to the fluidized beds thus described, the components thereof are referred to by the same reference numerals.

The gases entering the chamber 14 from the bed cells A, B, C, and D; and the gases from the bed cell E mix in the chamber 14 and rise by natural convection to the upper portion of the latter chamber before exiting through an opening 42 formed through the upper portion of the wall 12 and passing into the housing 16.

The convection section 18 in the housing 16 includes a plurality of tube bundles shown schematically at 44 through which water or steam is passed by an external piping system (not shown), so that the water or steam removes heat from the gases as the latter passes over the tubes.

The dust collector 20 receives the gases from the tube bundles 44 and operates in a conventional manner to separate the solid particulate material entrained therein from the gases. The relatively clean gases pass from the dust collector 20 through an outlet 46 to external equipment (not shown). The dust collector 20 includes a hopper 48 which collects the fine particles separated from the effluent gases and passes same into an injector 50 which injects the particles back to the fluidized bed cell E. The particles in the bed cell E are fluidized and combusted in a manner similar to the particulate coal in the fluidized bed cells A, B, C, and D as described.

In operation, air is passed into each fluidized bed disposed in the bed cells A, B, C, and D to fluidize each bed, it being understood that the velocity and rate of flow of the air is regulated so that it is high enough to fluidized the particulate fuel and to obtain economical burning, or heat release rates, per unit area of bed, yet is low enough to avoid the loss of too many fine fuel particles from the bed and to allow sufficient residence time of gases for good sulfur removal by the absorbent added to the bed. The heated air, after passing through each fluidized bed, combines with the combustion products from the bed and the resulting mixture, or gas (hereinafter referred to as the effluent gases) exit through the openings 40 in the wall 8 and flow into the heat recovery chamber 14. The effluent gases from the bed cell E, along with the gases from the cells A, B, C, D, rise by natural convection in chamber 14, exit from the chamber through the opening 42 and flow into the housing 16. In the housing 16 the effluent gases flow downwardly across the tube bundles 44 in the convection section 18 to remove heat from the gases before they pass into the dust collector 20. The dust collector 20 separates the gases from the particles entrained therein, with the gases exiting through the outlet 46, the separated particles exiting from the dust hopper 48. The latter particles, which include flyash and unreacted fuel and absorbent, are injected to the fluidized bed cell E, where they form a portion of the fluidized bed and are combusted along with the remaining particles in the bed.

Several advantages result from the foregoing. For example, the material handling equipment required in the system of the present invention is minimized, thus considerably reducing the cost of the entire steam generator. Also, the hot fluidized bed and exiting effluent gases in cell E heat the recycled particles from the dust collector 20 and initiate combustion of any unburned fuel and absorbent particles contained in the recycled stream, to improve the efficiency of the system. Further, the effluent gases in the chamber 14 have a relatively long residence time since they must travel the full height of the chamber 14 and are maintained at a temperature high enough to promote their combustion by the periodic addition of the hot fuel gases entering from the bed cells A, B, C, and D. Also, any sulfur dioxide entering the chamber 14 is further reacted with the fine limestone particles as the gases travel upwardly in the chamber 14, resulting in a maximum efficiency of sulfur capture and minimum limestone requirements to control sulfur dioxide emissions. Still further, the present invention enables construction of an extremely tall freeboard section above the bed cell E so as to insure the foregoing advantages.

Figure 2:
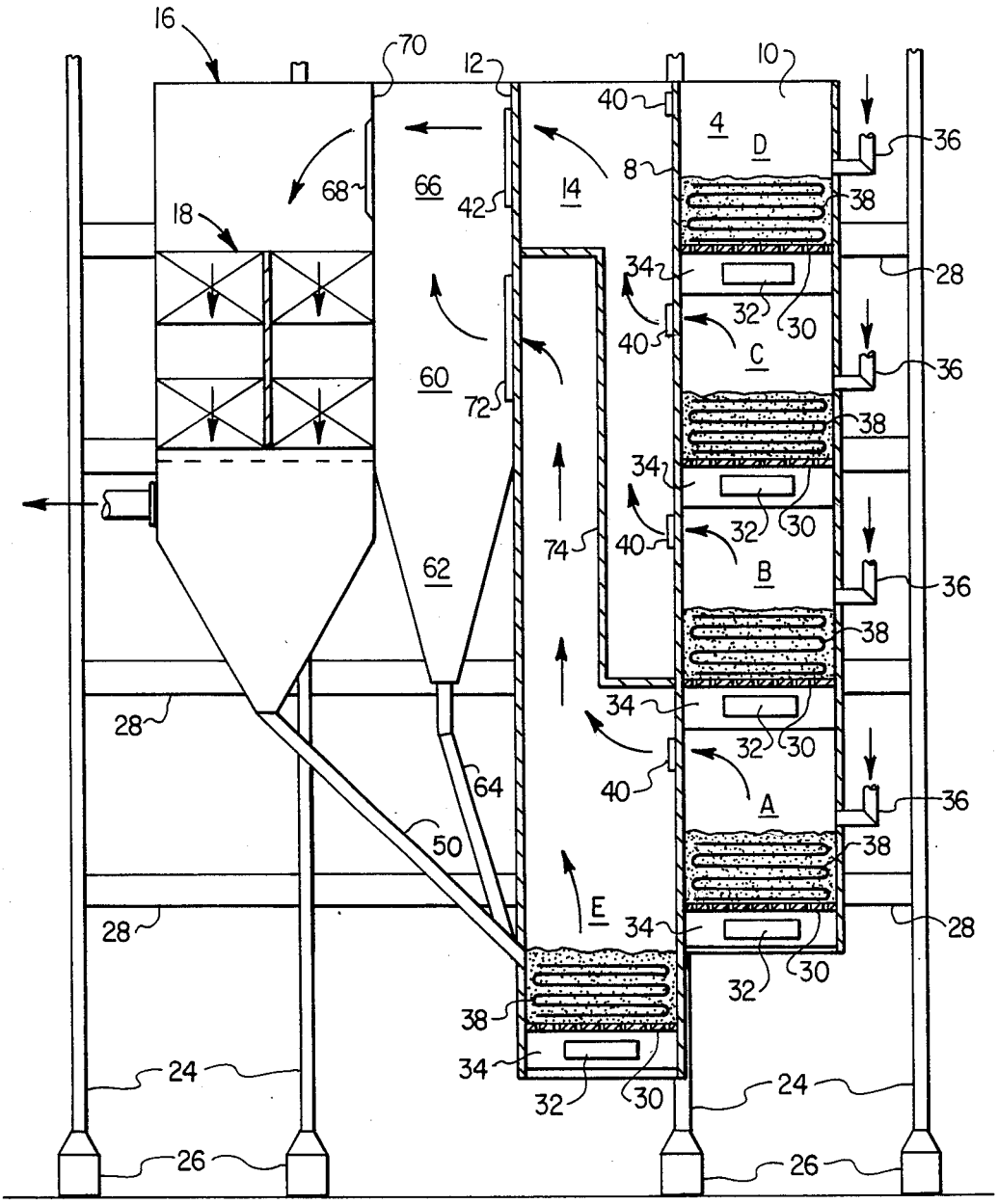
FIG. 2 is a view similar to FIG. 1 but depicting an alternate embodiment of the steam generator of the present invention.

FIG. 2 depicts an alternate embodiment of the steam generator of the present invention and includes many of the components of the previous embodiment which are given the same reference numerals.

According to the embodiment of FIG. 2, the convection section 18 and the separator 20 are spaced from the wall 12, and a high temperature refractory cyclone 60 is disposed in the space thus defined. The cyclone 60 includes a hopper 62 which receives separated solid portions and discharges same, via an injector 64, back to the fluidized bed cell E. A flow chamber 66 is defined immediately above the cyclone 60 for reasons that will be described. An opening 68 is formed through an upper wall 70 extending between the flow chamber 66 and the convection section 18 and an opening 72 is formed in the wall 12 below the opening 42 and communicates with the cyclone 60.

A partition 74 is disposed in the chamber 14 and functions to direct the effluent gases from the bed cells B, C & D upwardly to a level above the separator 60 where they exit from the opening 42 as in the previous embodiment. The gases then pass through the flow chamber 66 and to the convection section 18 where they pass across the tube bundles 44 and into the dust collector 20. The entrained particles are separated from the gases and passed to the hopper 48, also as in the previous embodiment.

The partition 74 also directs the effluent gases from the bed cells A and E upwardly to the opening 72 in the wall 12. The gases pass through the opening 72 and into the cyclone 60 where the entrained particles are separated therefrom and pass into the hopper 62. The relatively clean gases from the separator 60 are discharged into the chamber 66 above the cyclone 60 to mix with the gases from the cells B, C, & D. The separated particles from the dust collector 20 and the cyclone 60 are injected by the injectors 50 & 64, respectively, into the bed cell E.

The cyclone 60 is a refractory lined, relatively large single cyclone and, as such, can operate at a relatively high temperature, such as 1500° F. The arrangement is such that the cyclone 60 receives considerably more solids than the dust collector 20 and, by virture of the ability of the cyclone 60 to operate at a relatively high temperature, the combustion efficiency of the system is increased. Also, by recycling a greater quantity of solids there is an increase in the quantity of fine absorbent particle material in the gases which increases the sulfur capture.

Thus the embodiment of FIG. 2 enjoys all of the advantages of the embodiment of FIG. 1, while further increasing the combustion efficiency and the sulfur capture.

Other changes may be made to the foregoing without departing from the scope of the invention. For example, in certain situations it is not necessary to provide a bundle of heat exchanger tubes can in the bed cell E, in which case the latter cell would function in the same manner as described, but without the heat removal providing by the tubes.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A steam generator comprising a furnace section, means defining a plurality of vertically spaced fluidized beds in said furnace section, one boundary wall of said furnace section having openings therein for permitting the discharge of effluent gases from said fluidized beds, means including said one boundary wall for defining a heat recovery enclosure adjacent said furnace section for receiving said effluent gases, means defining a fluidized bed in said heat recovery enclosure, housing means disposed adjacent said heat recovery enclosure for receiving the effluent gases from said heat recovery enclosure, means in said housing means for removing heat from said gases, a cyclone separator disposed in said housing, a multi-cyclone device disposed in said housing adjacent said cyclone separator, means for selectively directing said effluent gases to said cyclone separator and to said multi-cyclone device for separating the entrained solid particles from said gases and means for injecting the separated solid particles into the fluidized bed in said heat recovery enclosure.

2. The steam generator of claim 1, wherein two walls of said furnace section and said heat recovery enclosure are formed by two continuous walls spanning the width of said generator.

3. The steam generator of claim 1 further comprising means in said fluidized bed in said recovery enclosure for removing heat from the said latter fluidized bed.

4. The system of claim 1 wherein the fluidized bed in said heat recovery enclosure is located in the lower portion of said enclosure so that the effluent gases from said latter fluidized bed pass upwardly through the entire length of said heat enclosure before exiting same.

5. The steam generator of claim 1 wherein the effluent gases from said vertically spaced fluidized beds combine with the effluent gases from said fluidized bed in said heat recovery enclosure.

6. The steam generator of claim 1 wherein said directing means comprises a flow passage connecting said heat recovery enclosure to said multi-cyclone device, and partition means disposed in said heat recovery enclosure for directing the effluent gases from at least one of said fluidized beds in said furnace section and the fluidized bed in said heat recovery section to said cyclone separator and for directing the effluent gases from the other fluidized beds in said furnace section to said flow passage for passing to said multi-cyclone device.

7. The steam generator of claim 1 wherein the effluent gases, after separation of solid particles therefrom in said cyclone separator, are passed to said multi-cyclone device.

8. The steam generator of claim 1 wherein said injection means is associated with said multi-cyclone device and said cyclone separator.

9. The steam generator of claim 1 further comprising means in each of said vertically spaced fluidized beds for removing heat from said latter beds.

10. The steam generator of claim 9 wherein said heat removal means comprises tube means, and means for passing water through said tube means.

11. A steam generator comprising a furnace section, means defining a plurality of vertically spaced fluidized beds in said furnace section, one boundary wall of said furnace section having openings therein for permitting the discharge of effluent gases from said fluidized beds, means including said one boundary wall for defining a heat recovery enclosure adjacent said furnace section for receiving said effluent gases, means defining a fluidized bed in said heat recovery enclosure, means for removing heat from said fluidized beds, housing means disposed adjacent said heat recovery enclosure for receiving the effluent gases from said heat recovery enclosure, means in said housing means for removing heat from said gases, a cyclone separator disposed in said housing, a multi-cyclone device disposed in said housing adjacent said cyclone separator, and means for selectively directing said effluent gases to said cyclone separator and to said multi-cyclone device for separating the entrained solid particles from said gases.

12. The steam generator of claim 11, wherein two walls of said furnace section and said heat recovery enclosure are formed by two continuous walls spanning the width of said generator.

13. The steam generator of claim 11 wherein said heat removal means comprises tube means, and means for passing water through said tube means.

14. The system of claim 11 wherein the fluidized bed in said heat recovery enclosure is located in the lower portion of said enclosure so that the effluent gases from said latter fluidized bed pass upwardly through the entire length of said heat enclosure before exiting same.

15. The steam generator of claim 11 wherein the gases from said vertically spaced fluidized beds combine with the gases from said fluidized bed in said heat recovery enclosure.

16. The steam generator of claim 11 wherein said directing means comprises a flow passage connecting said heat recovery enclosure to said multi-cyclone device, and partition means disposed in said heat recovery enclosure for directing the effluent gases from at least one of said fluidized beds in said furnace section and the fluidized bed in said heat recovery section to said cyclone separator and for directing the effluent gases from the other fluidized beds in said furnace section to said flow passage for passing to said multi-cyclone device.

17. The steam generator of claim 11 wherein the effluent gases, after separation of solid particles therefrom in said cyclone separator, are passed to said multi-cyclone device.

18. The steam generator of claim 11 wherein said injection means is associated with said multi-cyclone device and said cyclone separator.

19. The steam generator of claim 11 further comprising means for injecting separated solid particles into the fluidized bed in said heat recovery enclosure.

* * * * *